US010661150B1

(12) United States Patent
Simpson

(10) Patent No.: US 10,661,150 B1
(45) Date of Patent: May 26, 2020

(54) ROLLING KNEE SUPPORT DEVICE

(71) Applicant: Lee A. Simpson, Castle Hayne, NC (US)

(72) Inventor: Lee A. Simpson, Castle Hayne, NC (US)

( * ) Notice: Subject to any disclaimer, the term of this patent is extended or adjusted under 35 U.S.C. 154(b) by 126 days.

(21) Appl. No.: 15/863,052

(22) Filed: Jan. 5, 2018

Related U.S. Application Data

(60) Provisional application No. 62/601,516, filed on Mar. 27, 2017.

(51) Int. Cl.
*A41D 13/06* (2006.01)
*A63C 17/00* (2006.01)
*A63C 17/04* (2006.01)

(52) U.S. Cl.
CPC ..... *A63C 17/0026* (2013.01); *A41D 13/065* (2013.01); *A63C 17/0033* (2013.01); *A63C 17/04* (2013.01); *A41D 2300/33* (2013.01)

(58) Field of Classification Search
CPC . A63C 17/0026; A63C 17/0033; A63C 17/04; A41D 13/065; A47C 16/04
See application file for complete search history.

(56) References Cited

U.S. PATENT DOCUMENTS 718,875 A * 1/1903 Peterson ..... A47C 9/027 280/32.5
1,382,883 A 6/1921 Ashbridge
1,547,166 A * 7/1925 Davidson ..... A41D 13/0568 2/24
1,737,836 A * 12/1929 Field ..... A47C 16/04 280/32.5
2,363,058 A * 11/1944 Gill ..... A41D 13/0568 2/24
2,480,406 A 8/1949 Forney
2,484,494 A * 10/1949 Ferguson ..... A41D 13/0568 2/24
3,976,155 A 8/1976 Esch
3,993,000 A 11/1976 Sherwood
4,138,763 A 2/1979 Cooley
4,377,309 A 3/1983 Mengshoel
4,892,305 A * 1/1990 Lynch ..... A63B 22/20 482/132
5,380,021 A * 1/1995 Doherty ..... A01B 75/00 280/32.5

(Continued)

*Primary Examiner* — James A Shriver, II
*Assistant Examiner* — Steve Clemmons
(74) *Attorney, Agent, or Firm* — Suzanne Kikel, Patent Agent

(57) ABSTRACT

A rolling knee support device is attached to each knee of the user for support thereof when the user is in a kneeling position. The device has four swivel caster type wheels with a threaded stem for being releasably mounted into one of eight holes defined in a double-curved lower surface of a base of the support. The four wheels can be moved and arranged such on the double-curved lower surface so that the supporting feature of the knee supporting device can be modified and customized according to the needs of the worker and/or the particular job whereby the worker is supported in the most comfortable, balanced, and efficient position and orientation for any particular job. Straps with fasteners are used to secure each rolling knee support device to each knee of the user.

8 Claims, 7 Drawing Sheets

(56) References Cited

U.S. PATENT DOCUMENTS 5,427,391 A * 6/1995 Cooper ..... A63C 17/0026 280/11.19
5,725,224 A * 3/1998 Kerr ..... A63C 17/0026 280/11.19
5,732,412 A * 3/1998 Holden ..... A41D 13/0562 2/23
5,870,774 A * 2/1999 Legenstein ..... A41D 13/0568 2/24
5,915,707 A * 6/1999 Steffen ..... A63C 17/0026 280/87.01
5,937,440 A * 8/1999 Ferriter ..... A41D 13/065 2/24
5,979,939 A * 11/1999 Siboni ..... A63C 17/0026 280/11.221
6,219,845 B1 * 4/2001 Ferriter ..... A41D 13/0568 2/24
6,422,152 B1 7/2002 Rowe
6,450,515 B1 9/2002 Guth
6,942,605 B1 * 9/2005 Sukhovitsky ..... A63B 21/0004 2/24
7,112,163 B2 9/2006 Krull
7,197,770 B1 * 4/2007 Warren ..... A63C 17/0026 2/24
7,681,248 B2 * 3/2010 Legenstein ..... A63B 71/1225 2/24
7,878,513 B2 2/2011 Damouzehtash
8,876,145 B1 * 11/2014 Bernal ..... B62B 5/0093 280/638
D732,182 S * 6/2015 Viner ..... D24/212
9,199,117 B1 * 12/2015 Nicholas ..... A63B 21/0004
9,701,010 B2 * 7/2017 Manjarres ..... A01B 75/00
9,961,948 B2 * 5/2018 Archuleta ..... A41D 13/065
2003/0236150 A1 * 12/2003 Huang ..... A63C 17/0033 482/51
2004/0108074 A1 * 6/2004 Marchetti ..... B65B 51/067 156/468
2005/0062242 A1 * 3/2005 Stone ..... A63C 17/01 280/32.5
2005/0081274 A1 4/2005 Vorhis
2006/0277642 A1 * 12/2006 Legenstein ..... A41D 13/065 2/24
2007/0114735 A1 * 5/2007 Teague ..... A41D 13/065 280/11.19
2015/0021869 A1 * 1/2015 Morgan, Jr. ..... A47C 9/027 280/32.5
2016/0286871 A1 10/2016 Beclervic

* cited by examiner

ROLLING KNEE SUPPORT DEVICE

CROSS REFERENCE TO RELATED APPLICATIONS

This application claims priority to U.S. Provisional Patent Application Ser. No. 62/601,516 filed Mar. 27, 2017, the disclosure of which is incorporated herein by reference in its entirety.

BACKGROUND OF THE INVENTION

1. Field of the Invention

The present invention relates generally to the field of kneeling pads or devices, and more specifically to a rolling knee support device that is padded, has removable swivel casters or wheels for mobility, is attachable to the knee of the worker, and is easily movable from one place to another as the work on the ground or floor progresses.

2. Brief Description of the Prior Art

Construction workers, landscapers, roofers, carpet layers, plumbers, electricians, farmers, and gardeners often spend hours on their knees over the course of their workday. The surfaces on which they kneel may be hard, gritty and abrasive, and/or wet and muddy. Knees generally become sore; clothing generally becomes dirty and wears quickly; and pants generally become wet; all of which present an uncomfortable situation for the rest of the work day. Typically, denim jeans and/or overalls provide little protection against the wear and discomfort of these surfaces. As a result, a number of devices, designed to provide a cushioning, protective layer between the knee and the kneeling surface have been introduced over the years.

In some situations, workers have equipped themselves with pillows or with knee pads which are strap onto the leg or held in place by elastic bands. These devices ease the pain or postpone the time for the pain to begin, but, in general, do not provide long term ease and comfort. Some styles of knee pads often apply pressure to the back of the knee and are poorly ventilated. Also, if the present day knee pads have straps, the straps may be caught on in the inside of the knee while the worker kneels, resulting in a high pressure being exerted on a relatively delicate area on the inside of the knee.

Simple knee pads are designed to cushion and protect the user's knee when the knees contact the ground or floor. Some styles of knee pads comprise a wear resistant surface layer that contacts the ground and a cushioned inside layer that contacts, directly or indirectly, the wearer's knee. Still other styles of knee pads merely comprise a cushion layer which cushions the knee against a hard surface.

Still other types of knee pads have a mechanism to facilitate rolling the knee pad along a surface. These rolling knee pads or cushions may be designed to protect the knee while also providing the user with a degree of mobility when the user is kneeling. In this type of knee pad, comfort and ease in mobility are important to the user. It is desirable that the rolling knee pad be easily moveable and that the user be able to rise and then kneel back down on the knee pad without the user having to manually orient the knee pad, since oftentimes, the user is either holding tools or materials.

Present-day knee supporting devices may work well in many applications; however, there are no known devices which allow the user the freedom to rise up from the kneeling position and off of the knee supporting device, and then to resume a kneeling position without having to reposition the pad and still have total kneeling mobility in any lateral direction.

There is, therefore, a need in the art to provide a rolling knee support device which will allow a user full freedom of movement while still being comfortable and versatile; and at the same time allow the user to stand upright and then to resume a kneeling position with the rolling knee support device without having to readjust the padding of the device.

Many workers must move around on their knees into various locations and assume various positions to complete their work. This may require the worker to tilt one direction or another while remaining on his knees. With present-day knee supporting devices, altering the orientation of the worker may cause the knee supporting device to be misaligned, and thus, do not provide full protection to the worker's knees.

There is a further need in the art to provide a knee supporting device that can be easily adapted to any particular working situation.

Some workers desire knee supporting devices to be located in a particular orientation with respect to their body, and some jobs may require the worker to shift his orientation during the course of his work resulting in the worker's balance and/or control being compromised.

There is still a further need in the art to provide a knee supporting device that can be easily and quickly modified to meet the needs and desires of the user, thereby allowing the user to maintain proper balance and to maintain his center of gravity.

Yet, a still further need in the art is to provide a knee supporting device which allows the user lateral movement in any direction while kneeling and quick movement across large spaces to retrieve tools and/or materials.

Some present day mobile knee supporting devices provide knee pads supported in an indentation to receive each knee of the user and which indentations are provided on a one-piece dolly.

There is still a further need in the art to provide a rolling knee support device which supports only one knee and wherein two such devices are securely attached, one to each knee of the user.

SUMMARY OF THE INVENTION

The present invention provides such a knee supporting device. The invention provides a rolling knee support device which is attached to a knee of the worker and wherein two such devices may be used. These two devices support each knee of the user when in a kneeling position, such as when he is installing tile. More particularly, the knee supporting device of the invention comprises: a one-piece base shell having an upper concave surface, a lower convex surface, two opposed curved side edges, two opposed curved ends. A longitudinal axis extends between the two opposed curved ends and parallel to the two opposed curved side edges, and a transverse axis extends between the two opposed curved side edges and parallel to the two opposed curved ends. The device further comprises several straps, each of which is attached at its one end to an opposed curved side edge of the base shell and having a releasable fastener, such as Velcro®, attached to its distal end. Several apertures are defined on the lower convex surface of the base shell, the apertures being spaced apart from each other and oriented in a series of rows extending in the direction of the transverse axis of the base shell, and which apertures are parallel to the two opposed curved side edges of the base shell, the rows of apertures being located adjacent to the two opposed side edges of the base shell on opposite sides of the longitudinal axis of the base shell. Several wheel assemblies are selectively mounted in one of the apertures in the lower convex surface of the base shell. In an embodiment of the invention, at least eight apertures are provided in the lower convex surface of the base shell and at least four wheel assemblies are provided and inserted selectively in one of the eight apertures.

The rolling knee support device supports the user's knee when the user is in a kneeling position, such as when he is installing tile. The device has wheels which are releasably mounted in apertures defined in the base of the support. The wheels can be moved so the supporting feature of the device can be modified and customized according to the needs of the worker and/or the particular job, whereby the worker is supported in the most comfortable, balanced, and efficient position and orientation for any type of job.

More specifically, in an embodiment of the invention, the rolling knee support device has at least four wheels for providing a good center of gravity and balance thereby allowing the user to easily maneuver along the floor/ground while having control of the knee-supporting device without having to slide the user's knees on kneepads alone while doing a big flooring project. This helps save a person's knees from developing sores and/or knee pain, which in turn, makes him/her more efficient. The device has a double-curved lower surface in which at least eight apertures are defined for receiving one of the four wheel assemblies. This feature allows a user to select the wheel combination, location, and orientation that is most efficient and best supports him/her in the most comfortable position regardless of the orientation and position the user must assume in order to complete a particular job. The device is thus versatile and of great use while rolling around performing flooring projects such as installing laminate flooring, vinyl, tiles, base board, and shoe molding. The wheels, the shape of the lower surface of the device of the invention, and the number of apertures for receiving a wheel allow the user to select a wheel combination and wheel orientation that is most effective in supporting the user and allows the user to change the location of the four wheels and/or their orientation with respect to the user's body in order to account for the demands of a particular job.

The device of the present invention gives the worker the ability to roll quickly and easily from one point to another and reduces physical stress by eliminating the need to be continually standing then kneeling between work points. The device of the invention also allows the worker to remain kneeling and still be able to move efficiently from task to task while retaining the most comfortable and effective position for the particular job. A primary feature of the invention is the ability of the base shell to roll about both its longitudinal and transverse axes so that the user can roll into the most comfortable position while being supported on his knees. To this end, the lower surface of the base shell is curved in two directions: a curvature around the transverse axis T and a curvature around the longitudinal axis L.

These and other features and advantages of the present invention will be better appreciated and understood when the following description is read along with the accompanying drawings.

BRIEF DESCRIPTION OF THE DRAWINGS

The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
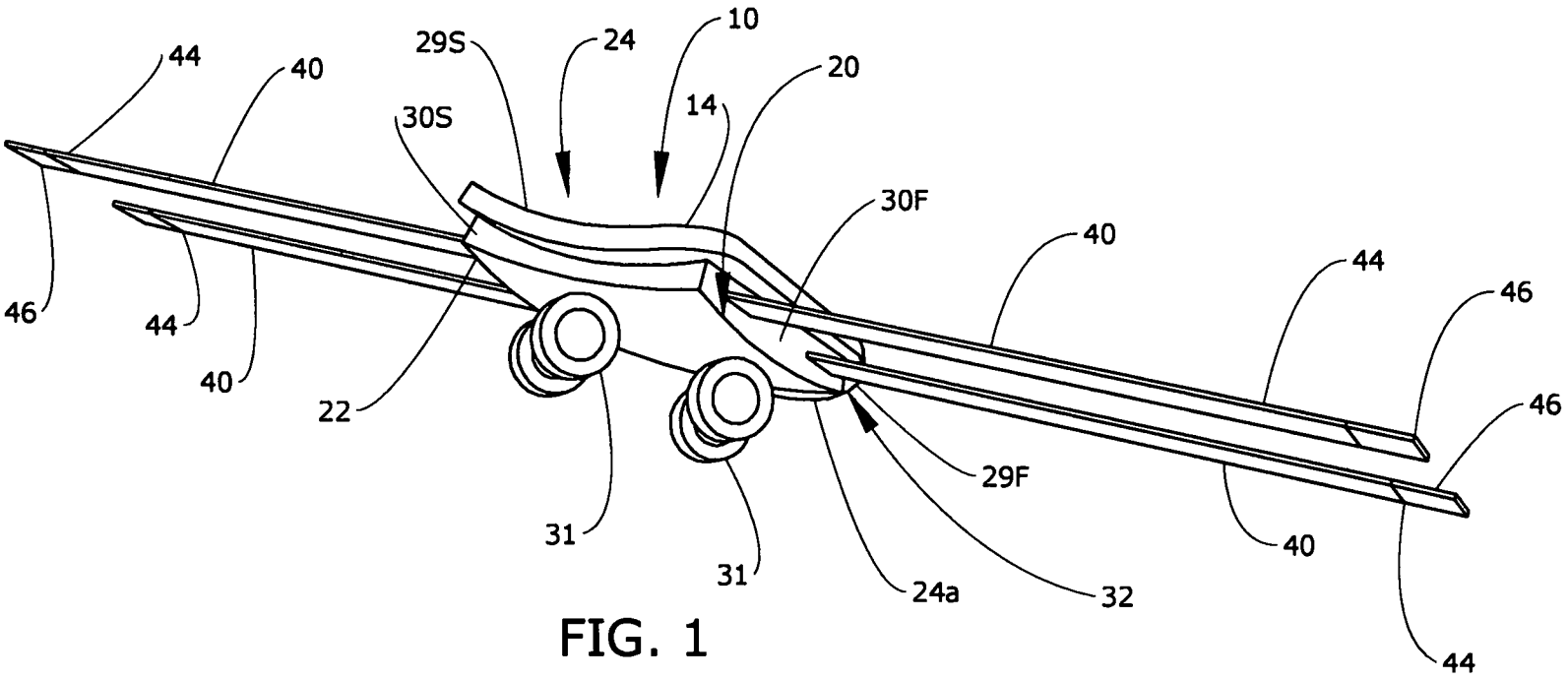
FIG. 1 is a schematic perspective bottom view of a rolling knee support device of the invention.
Figure 2:
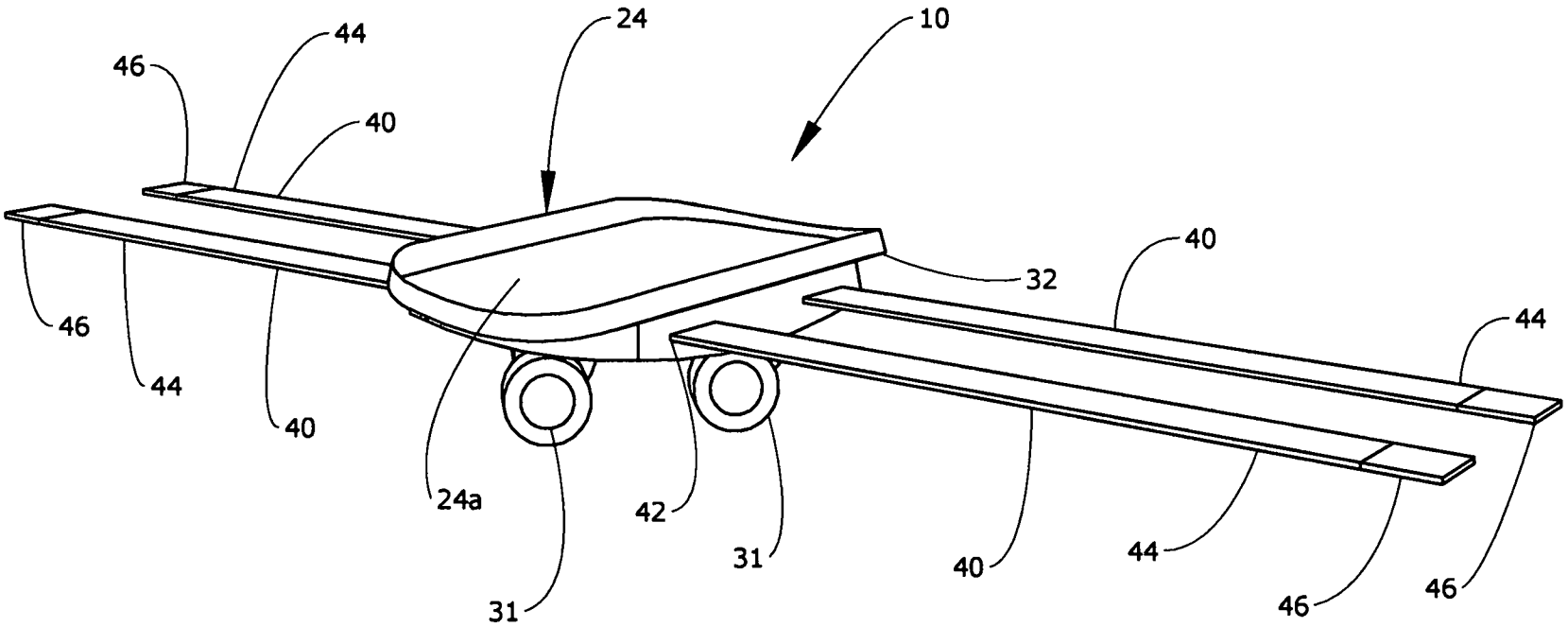
FIG. 2 is a schematic perspective side view of the rolling knee support device of the invention.
Figure 3:
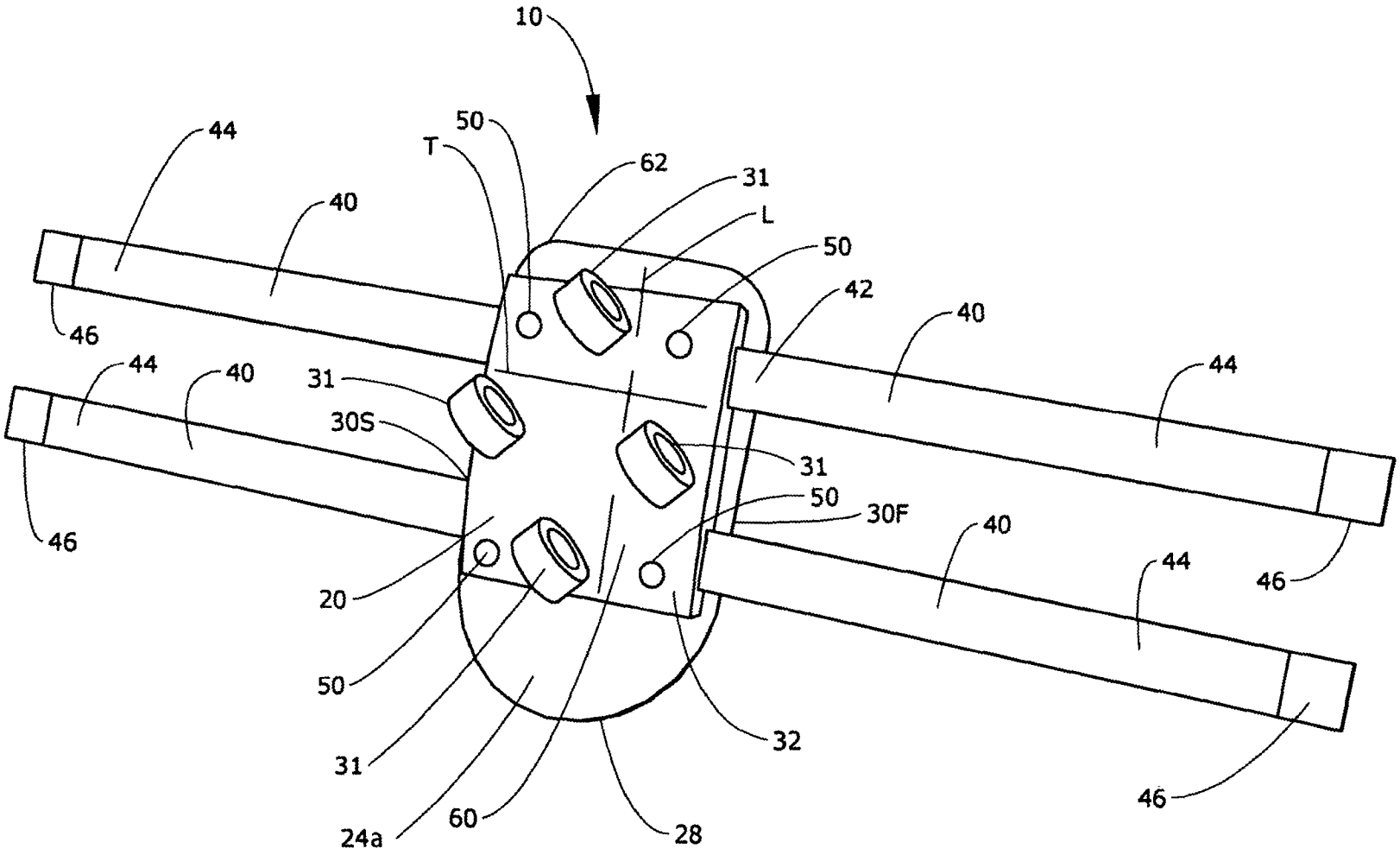
FIG. 3 a schematic perspective bottom view of the rolling knee support device of the invention illustrating a plurality of wheel-accommodating holes defined therein.

FIGS. 1 through 3 illustrate a rolling knee support device 10, which is comprised of a one-piece base shell 20. Base shell 20 has an upper concave surface 22 that is shaped and sized to comfortably accommodate a user's knee and upper shin when device 10 is used. A kneepad 24 has a layer of foam padding 24*a* and is located on upper concave surface 22 of base shell 20. As best illustrated in FIG. 3, foam padding 24*a* has a front edge 28 which is in the shape of a horseshoe and large enough to ensure a sufficient area to comfortably accommodate the knee of the user. Referring particularly to FIG. 1 and FIG. 3, base shell 20 has a longitudinal axis L (FIG. 3) which as shown in FIG. 1 extends between a first end 29F and a second end 29S of base shell 20, and a transverse axis T (FIG. 3) which as shown in FIG. 1 extends between a first side edge 30F and a second side edge 30S of base shell 20. It is to be appreciated that first end 29F and second end 29S of base shell 20 are opposed ends in that they are opposite to each other; and first side edge 30F and second side edge 30S of base shell 20 are opposed side edges in that they are opposite to each other.

Referring again to FIG. 3, base shell 20 further comprises a lower convex surface 32. In an embodiment of the invention, lower convex surface 32 contains at least four wheel assemblies 31 and four straps 40. It can be appreciated that at least two straps 40 are connected to opposed first and second ends 29F and 29S (FIG. 1) of base shell 20. Each strap 40 has a distal end 44 containing a hook-and-loop fastener 46, such as, for example, Velcro® hook-and-loop fastener. When rolling knee support device 10 is used by a workman, straps 40 are looped around the user's leg and are held in place via the hook-and-loop fasteners 46 so as to secure device 10 to the knee of the user.

Figure 4:
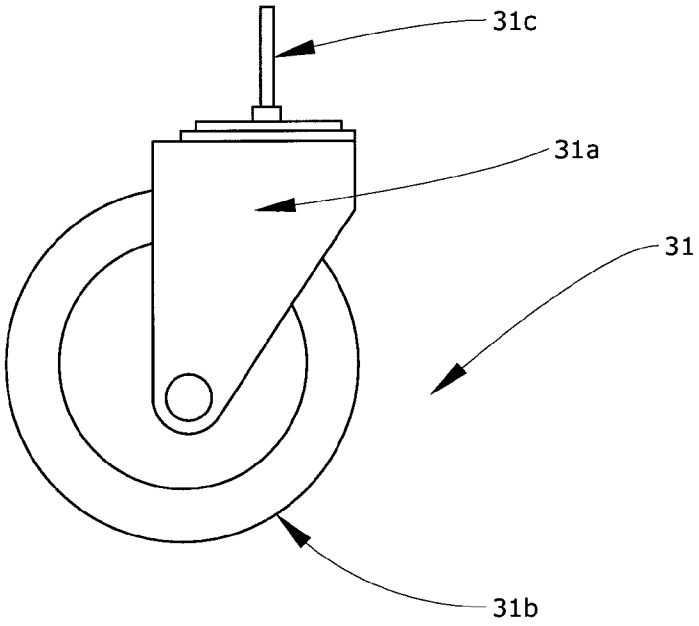
FIG. 4 is an enlarged view of a threaded stem caster wheel assembly for use in the invention.

Still referring to FIG. 3, each wheel assembly 31 is mounted in one of eight apertures 50 provided on the lower convex surface 32 of base shell 20. FIG. 4 illustrates an example of wheel assembly 31. Preferably, wheel assembly 31 is of the swivel caster type, has a stainless steel frame 31*a*, a four inch hard rubber wheel 31*b*, and a four inch threaded stem 31*c*. Such a swivel caster wheel is available from Service Caster Corporation in West Reading, Pa. and has about a 300 pound weight capacity. It is to be appreciated that other types of swivel caster wheel assemblies may be used in the invention depending on the weight requirements of the user. In view of the arrangement of wheel assemblies 31 in lower convex surface 32 of device 10, when in use of device 10, the wheel assemblies will swivel in a plane perpendicular to a plane containing the lower convex surface 32 of base shell 20 and will roll in a plane parallel to the lower convex surface of the base shell so that device 10 is easily maneuvered. Even though the swivel caster type wheel of FIG. 4 has been discussed in terms of the invention, it is to be appreciated that other types of wheel assemblies may be used in the invention in a manner well-known to those skilled in the art.

Figure 5:
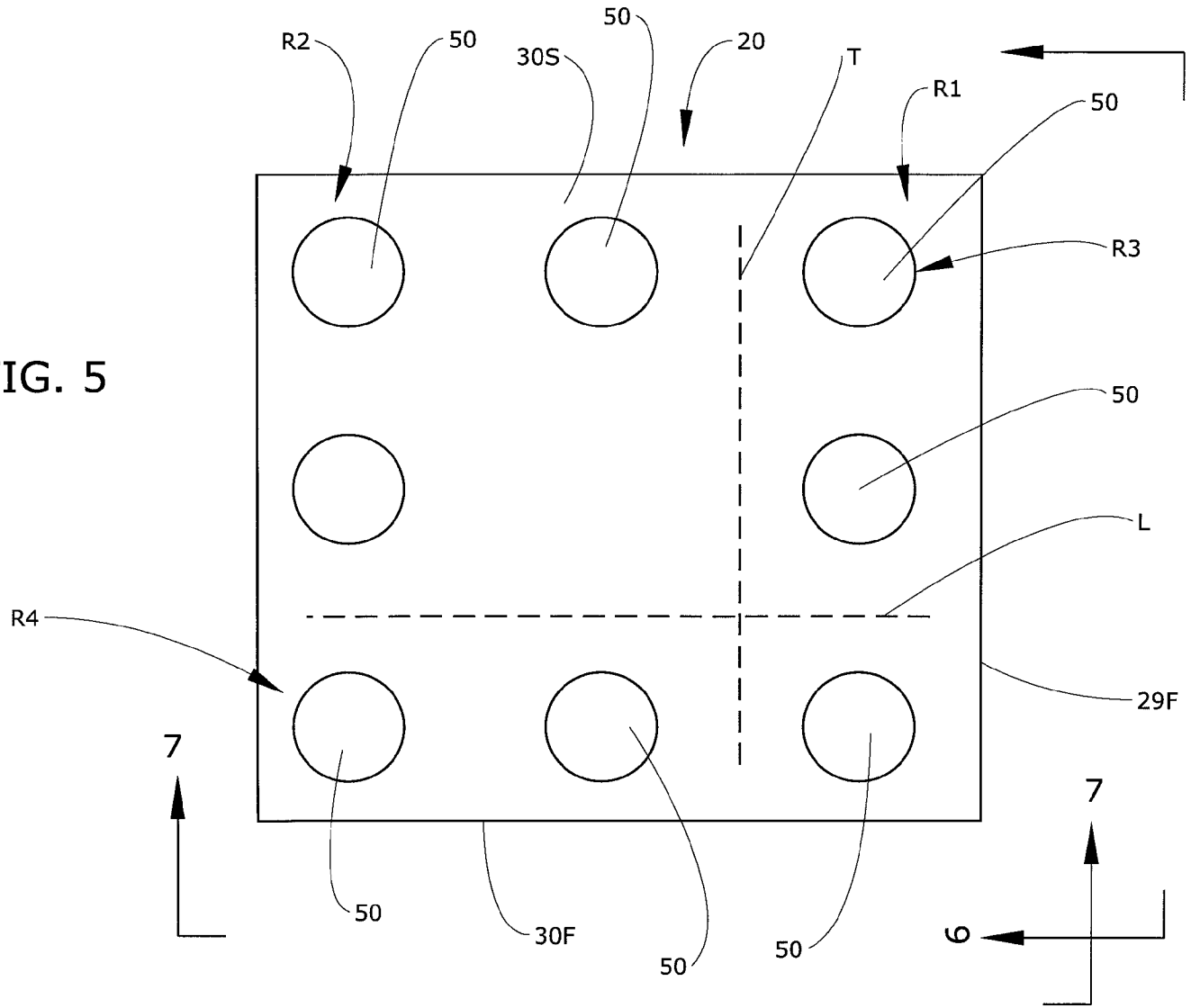
FIG. 5 is an enlarged schematic plan view of the lower convex surface of the base shell of the device.

With particular reference to FIG. 5, and as discussed herein above, lower convex surface 32 of base shell 20 has at least eight apertures 50, four of which generally will accommodate one of the four wheel assemblies 31 at any one time when device 10 is being used in a floor project. Even though not shown, it is to be appreciated that each aperture 50 has an inner threaded surface that corresponds to the threads of the threaded stem 31*c* of wheel assembly 31. As shown in FIG. 5, at least three apertures 50 are arranged in two spaced-apart rows R1, R2 running parallel to the transverse axis T and which rows R1, R2 are essentially parallel with a plane containing first end 29F and second end 29S of base shell 20. Still referring to FIG. 5, at least three apertures 50 are arranged in two spaced apart rows R3, R4 running parallel to the longitudinal axis L of base shell 20 and which rows R3, R4 are essentially parallel with a plane containing first side edge 30F and second side edge 30. As discussed herein above and with particular reference to FIG. 4, each wheel assembly 31 has a threaded stem 31*c* which allows each wheel assembly 31 to be easily threaded into aperture 50, then removed, and then threaded back into another aperture 50 depending on the job a worker is performing.

Figure 6:
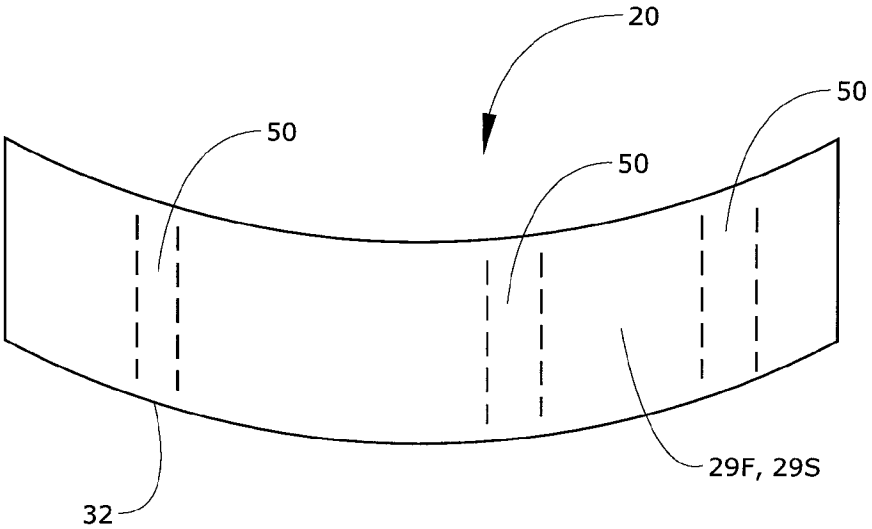
FIG. 6 is an enlarged schematic side view taken along lines 6-6 of FIG. 5.
Figure 7:
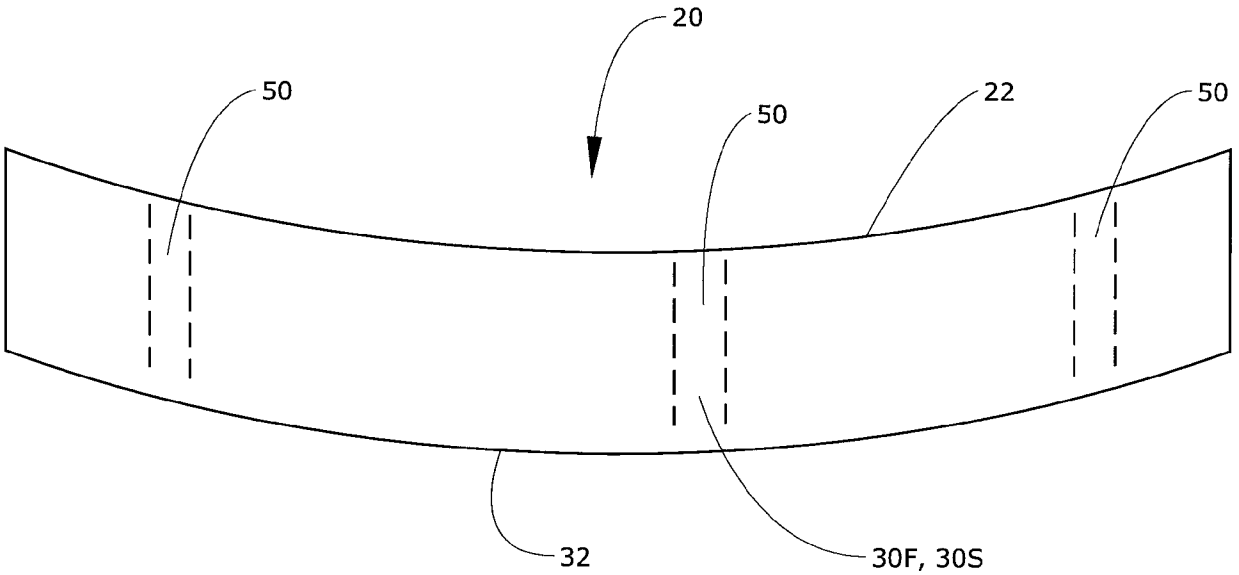
FIG. 7 is an enlarged schematic side view taken along lines 7-7 of FIG. 5.

As best appreciated in FIGS. 6 and 7, lower convex surface 32 of base shell 20 is curved in two directions (that is, along the traverse axis T and the longitudinal axis L) in order to allow wheel assemblies 30 to be oriented at angles with respect to kneepad 24, whereby further control of the user's balance can be affected by inserting wheel assemblies 31 in the most appropriate apertures 50. Even though FIGS. 6 and 7 illustrate the double curvature of base shell 20, this double curvature of base shell 20 is further indicated in FIG. 3 by curved surface-defining lines 60 and 62 to more clearly indicate that the lower convex surface 32 of base shell 20 is curved in two directions. By allowing wheel assemblies 31 to be oriented at various angles with respect to kneepad 24, each wheel assembly 31 can be tilted in order to allow the user to have his weight supported in a line when he is tilted to one side or is tilted forward or backward as may be required by the job the wearer of each rolling knee support device 10 is performing. Examples for the direction for the movement of wheel assemblies 31 are illustrated in FIGS. 1 through 3.

The spacing and orientation of apertures 50 allow the user of device 10 to select the apertures that are most favorable to the worker's desired center of gravity, balance, orientation, and position for the required job. This option allows the user to move the wheel assemblies 31 so that their placement in lower convex surface 32 of base shell 20 can be adjusted to fit the particular needs of the worker and the particular job and yet allow the worker to maintain his balance and center of gravity while allowing for adjustments of the wheel assemblies during a particular job or from job-to-job. This option allows the worker greater flexibility and versatility while being as comfortable as possible. It is to be noted that while an embodiment of the invention provides for device 10 having apertures 50 arranged as indicated in FIG. 5, other arrangements and/or numbers of apertures 50 may be provided without departing from the scope of the invention.

While the present invention has been described in connection the preferred embodiments of the various figures, it is to be understood that other similar embodiments may be used or modifications and additions may be made to the described embodiment for performing the same function of the present invention without deviating therefrom. Accordingly, it is intended by the appended claims to cover all such changes and modifications as come within the spirit and scope of the invention.

What is claimed is:

1. A rolling knee support device, comprising:

a one-piece base shell having an upper concave surface, a lower convex surface, two opposed side edges, two opposed ends, a longitudinal axis extending between the two opposed ends and extending parallel to the opposed side edges, and a transverse axis extending between the two opposed side edges and extending parallel to the opposed ends;

at least two sets of straps, each strap being attached at its one end to one of the two opposed side edges of the one-piece base shell and each strap having a releasable fastener attached on its distal end;

at least eight apertures located in the lower convex surface of the base shell, the apertures being spaced apart from each other and arranged in the lower convex surface along the two opposed side edges and the two opposed ends of the one-piece base shell; and at least four wheel assemblies, each wheel assembly being selectively mountable in one of the apertures in the lower convex surface of the base shell depending on the job being performed by the user.

2. The rolling knee support device of claim 1 further comprises a kneepad supported by the upper concave surface of the base shell and a layer of foam padding located on the kneepad.

3. The rolling knee support device of claim 1 wherein the lower convex surface of the base shell has a first convex curve along the transverse axis and a second convex curve along the longitudinal axis, and wherein the base shell is substantially open at the two opposed ends.

4. The rolling knee support device of claim 1 wherein the releasable fastener attached on the distal end of each strap comprises a hook and loop fastener.

5. A rolling knee support device, comprising:

a one-piece base shell having an upper concave surface, a lower convex surface, two opposed side edges, two opposed ends, a longitudinal axis extending between the two opposed ends and extending parallel to the opposed side edges, and a transverse axis extending between the two opposed side edges and extending parallel to the opposed ends;

at least two sets of straps, each strap being attached at its one end to one of the two opposed side edges of the one-piece base shell and each strap having a releasable fastener attached on its distal end;

more than four apertures located in the lower convex surface of the base shell, the apertures being spaced apart from each other and arranged in the lower convex surface along the two opposed side edges and the two opposed ends of the one-piece base shell; and at least four wheel assemblies, each wheel assembly being selectively mountable and interchangeable in one of the apertures in the lower convex surface of the base shell depending on the job being performed by the user.

6. The rolling knee support device of claim 5 further comprises a kneepad supported by the upper concave surface of the base shell and a layer of foam padding located on the kneepad.

7. The rolling knee support device of claim 5 wherein the lower convex surface of the base shell has a first convex curve along the transverse axis and a second convex curve along the longitudinal axis, and wherein the base shell is substantially open at the two opposed ends.

8. The rolling knee support device of claim 5 wherein the releasable fastener attached on the distal end of each strap comprises a hook and loop fastener.

* * * * *